United States Patent [19]

Shioi et al.

[11] 4,232,214

[45] Nov. 4, 1980

[54] PTC HONEYCOMB HEATING ELEMENT WITH MULTIPLE ELECTRODE LAYERS

[75] Inventors: Ryoichi Shioi; Tamotu Yamauchi, both of Nikaho, Japan

[73] Assignee: TDK Electronics Company Limited, Tokyo, Japan

[21] Appl. No.: 14,283

[22] Filed: Feb. 22, 1979

[30] Foreign Application Priority Data

Feb. 22, 1978 [JP] Japan ..... 53/18573
Feb. 22, 1978 [JP] Japan ..... 53/18574

[51] Int. Cl.[3] ..... H05B 3/08

[52] U.S. Cl. ..... 219/541; 219/338; 219/543; 219/553; 219/381; 338/22 R; 338/327; 252/520

[58] Field of Search ..... 219/307, 338, 362, 337, 219/374, 381, 541, 543, 553; 338/22 R, 22 SD, 283, 297, 323, 327; 252/518, 520

[56] References Cited

U.S. PATENT DOCUMENTS

| | | | |
|---|---|---|---|
| 2,882,377 | 4/1959 | Rinehart | 219/543 X |
| 2,961,522 | 11/1960 | Hammer | 219/543 X |
| 3,927,300 | 12/1975 | Wada et al. | 219/381 |
| 3,995,143 | 11/1976 | Hervert | 219/553 |
| 4,032,752 | 6/1977 | Ohmura et al. | 219/541 |
| 4,107,515 | 8/1978 | Kulvicki | 219/541 |

*Primary Examiner*—Volodymyr Y. Mayewsky
*Attorney, Agent, or Firm*—Armstrong, Nikaido, Marmelstein & Kubovcik

[57] ABSTRACT

In a honeycomb heating element comprising a PTC thermister body, a single electrode layer composed of a silver paste was conventionally used for applying power to the body. In the present invention, two or three electrode layers with improved electrical and chemical properties are used to provide the heating element with a long service life, improved reliability and a high heat generation.

14 Claims, 7 Drawing Figures

PTC HONEYCOMB HEATING ELEMENT WITH MULTIPLE ELECTRODE LAYERS

The present invention relates to a heating element comprising a semiconductor ceramic article of a honeycomb structure having a positive temperature coefficient of electrical resistance and composed of barium titanate, as well as the process for producing such a heating element.

The semiconductor ceramic article composed of the barium titanate and having a positive temperaure coefficient of electrical resistance (hereinafter referred to as a PTC thermister) has outstanding features, namely the fact that optional heating temperatures can be obtained by adjusting the Curie point of the PTC thermister, and that there is no danger that the PTC thermister will overheat. This is because, the resistance of the PTC thermister is suddenly increased at a temperature exceeding the Curie point. Accordingly, the PTC thermister is attractive because of its automatic temperature control and, therefore, has been used in various heating elements.

When a honeycomb PTC thermister body including a number of through-holes is assembled with a fan and the like for the forced circulation of air through the through-holes, it can be practically used in an air heater, hair driers and other types of driers. Since the resistance of the PTC thermister is abruptly increased over a certain temperature determined by the Curie point, for example a temperature from 170° to 190° C., the current conduction through the honeycomb heating element comprising a PTC thermister is suppressed.

The following advantages over a heating element comprising an iron chromium alloy are available with a heating element comprising a PTC thermister. With the PTC thermister a temperature controlling mechanism, such as a fuse or a thermostat, is unnecessary. There is no danger of overheating and breaking of conduction with regard to the PTC thermister body and, therefore, the heating element has a long service life. It is easy to install the PTC thermister body into the heating element. The amount of heat generation per a unitary surface of the PTC thermister body is larger than with a heating element comprising an iron chromium alloy. With the PTC thermister, the heating rate is high at the beginning of a heating operation and the amount of heat generation of the heating element can be adjusted by adjusting the rate of flow of air. Finally, it is possible to apply a large amount of power to the PTC thermister body and to control the amount of heat generation, although the PTC thermister body is small in size.

It is known from U.S. Pat. No. 4,032,752 that the PTC thermister body is shaped as a honeycomb structure provided with a number of through-holes, and further, an ohmic electrode is provided on both ends of the PTC thermister having the honeycomb structure. When such ohmic electrodes as disclosed in this Patent are used in heating elements, it is difficult to increase the output or heat generation therefrom. Generally speaking, in order to increase the output from the honeycomb heating elements, the lattices defining the through holes therebetween, namaly the partition wall of the honeycomb heating element, must have a small thickness. Such decrease of the lattice thickness leads advantageously to the increase of heat diffusion, however, the width of the ohmic electrodes formed on the lattices is inevitably decreased. This, in turn, naturally results in the current value relative to the dimension of the electrodes being increased. From a point of view of an inherent property of a PTC thermister, i.e. a negative temperature coefficient of resistance below the Curie point, a considerably high current is conducted through the PTC thermister body and the ohmic electrodes when the temperature level of the PTC thermister body arrives at the Curie point. As a result of the facts mentioned above, the ohmic electrodes may be partly burned due to sparks between the ohmic electrodes and the PTC thermister body. In order to prevent the reduction of the service life due to, for example, sparks, it is necessary to considerably increase the thickness of the ohmic electrodes which are provided on both ends of the PTC thermister body according to the known structure of the PTC honeycomb heating element. Consequently, heating element becomes expensive due to this increase of the thickness of the electrodes.

In addition to the reasons mentioned above for the necessity of having thick electrodes, various additives are added to the electrode material, so as to realize an ohmic contact between the electrodes and the PTC thermister, and this results in a further requirement for thick electrodes. This is because the electric conductivity of the electrodes, which mainly contain silver, is decreased by the addition of the additives to some extent. Therefore, it has been indispensable to provide the electrodes with a relatively large thickness due to the inclusion of the additives mentioned above.

Furthermore, under the effect of electrical current an electromigration is caused between the conventional silver electrodes and the PTC thermister body, and the PTC thermister may in turn be short-circuited due to silver which has migrated along the PTC thermister body.

It is known from U.S. Pat. No. 3,927,300 that, in order to form the ohmic electrodes on the PTC thermister body in the honeycomb form, an aluminum hot spraying method and a screen printing method of an ohmic paste composed mainly of silver is used to form a coating layer, which is then baked. The silver- and aluminum-electrodes produced by the process of the U.S. Patent mentioned above involve a problem in resistance against atmospheric conditions and, hence, are not reliable. Namely, the aluminum or silver electrode of U.S. Pat. No. 3,927,300 is liable to corrode under the influence of air which includes a saliferous moisture and aggressive gas, such as a sulfur dioxide and a hydrogen sulfide.

It is, therefore, an object of the present invention to improve the electrical and chemical properties of the electrodes formed on the honeycomb, PTC thermister body of a heating element.

It is another object of the present invention to provide a process for producing a heating element provided with the above mentioned electrodes having the improved electrical and chemical properties.

According to the objects of the present invention there is provided a heating element, hereinafter referred to as the heating element with two electrode layers, comprising a semiconductor ceramic body of a honeycomb structure, the material of said semiconductor ceramic body having a positive temperature coefficient of resistance over a Curie point and composed of barium titanate (a PTC thermister), wherein a pair of inner, electric conductive layers comprising mainly silver are provided on both end surfaces of the semiconductor ceramic body, electrically connected to a source for supplying power to the semiconductor ceramic body, characterized in that an outer, electric conductive layer consisting of at least one metal selected from the group consisting of nickel, zinc and chromium is provided on each of the inner layers.

Another heating element, hereinafter referred to as the heating element with three electrode layers, comprises a semiconductor ceramic body of a honeycomb structure, the material of the semiconductor ceramic body having a positive temperature coefficient of resistance over a Curie point and composed of barium titanate (a PTC thermister), wherein a pair of inner, electric conductive layers comprising mainly silver are provided on both end surfaces of the semiconductor ceramic body, electrically connected to a source for supplying power to the semiconductor ceramic body, characterized in that an intermediate layer consisting of at least one metal selected from the group consisting of silver, gold and copper is provided on each of the lower layers, and an outer layer consisting of at least one metal selected from the group consisting of nickel, zinc and chromium is provided on each of the intermediate layers.

The process for producing the heating element with two electrode layers is characterized in that the process comprises, in addition to the known screen printing step of the inner, electric conductive layers, a step of plating on each of the inner layers an outer, electric conductive layer consisting of at least one metal selected from the group which consists of nickel, zinc and chromium.

The process for producing the heating element with three electrode layers is characterized in that the process comprises, in addition to the known, screen printing step of the inner, electric conductive layers, a step of screen printing or electrolytically depositing on each of said inner layers an intermediate, electric conductive layer consisting of at least one metal selected from the group, which consists of silver, gold and copper, and a step of plating on each of the intermediate layer an outer, electric conductive layer of at least one metal selected from the group which consists of nickel, zinc and chromium.

The present invention is explained in detail with reference to the drawings, wherein.

From the explanation set forth below, other objects and embodiments of the present invention will be apparent.

The honeycomb PTC thermister body 1 (FIGS. 6 and 7) may be composed of any known PTC thermister material, but is preferably composed of such a PTC thermister material as disclosed in U.S. patent application Ser. No. 882,922, filed by Shioi (one of the present Applicants) et al.

Generally, the PTC thermister body of the heating element is column shaped. The round-, rectangular-, square- or hexagonal-shaped channels or through holes, extend through the columnar body generally parallel to each other. The solid parts of the PTC thermister body have an almost uniform thickness with one another and constitutes the partitions for defining the through-holes or channels. The electrodes are connected to the opposite ends of the partition wall parts by the aid of a screen printing technique, and the like. The fluid feeding means is usually a fan or the like and is fixedly positioned in the axial direction of the columnar PTC thermister body.

Figure 6:
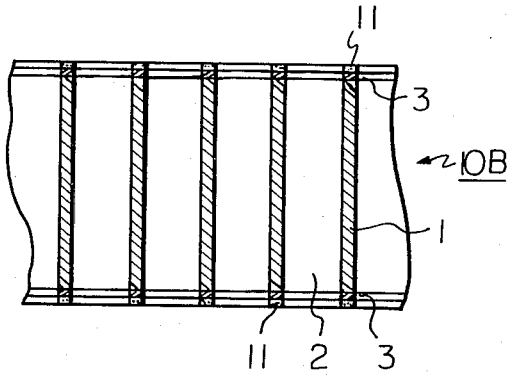
FIG. 6 is a cross sectional view of an embodiment of the heating element with two electrode layers.

The inner and outer layers of the heating element with the two electrode layers are denoted in FIG. 6 as 3 and 11, respectively. The two electrode layers, which consist of the inner silver paste layer 3 containing adhesive oxide and the outer metallic layer 11 free from the adhesive oxide, prevent the burning of these layers, although the total and individual thicknesses of these layers 3 and 11 are considerably small. Generally speaking the thickness of the electrode becomes thin when the thickness d of the partition wall is increased. In the present invention, the thickness d of the partition wall can be decreased from that of the prior art and, thus, the amount of heat generation can be increased, because of thin electrode layers. The thickness d of the partition wall 4 is advantageously small and ranges from 0.15 to 3 mm, and the total thickness of the inner and upper layers is from 10 to 35 microns on each side of the PTC thermister body. The thickness of the inner layer 3 is preferably from 5 to 10 microns, and the thickness of the outer layer is preferably from 5 to 20 microns.

Figure 7:
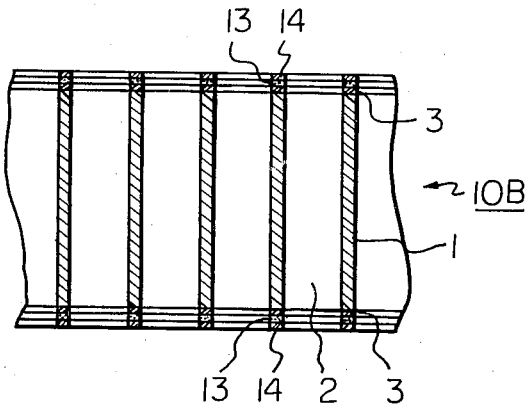
FIG. 7 is a cross sectional view of an embodiment of the heating element with three electrode layers.

The inner, intermediate and outer layers of the heating element with the three electrode layers are denoted in FIG. 7 as 3, 13 and 14, respectively. The intermediate layer 13 consists of a metal or metals, i.e. silver, gold and copper, and exhibits a high electric conductivity. The intermediate layer 13 is preferably from 5 to 20 microns thick. The outer layer 14 consists of a metal or metals, i.e., nickel, zinc and chromium, and exhibits a good resistance against atmospheric conditions. The outer layer 14 is preferably from 3 to 7 microns thick. Since the three electrode layers 3, 13 and 14 are used for the electrodes, the thickness d of the partition wall of the honeycomb PTC thermister body 1 is advantageously small, without causing the burning of the inner layer 3 and the increase of the inner layer thickness. The thickness d of the partition wall 4 is advantageously small and ranges from 0.15 to 3 mm, and the total thickness of the inner, intermediate and outer layers is from 15 to 40 microns on each side of the PTC thermister body.

When the thickness of the layers 3, 11, 13 and 14 formed on the ends of the PTC thermister body 1 (FIGS. 6 and 7) is reduced to less than the thickness of 30 microns according to a known heating element, not only is the cost of the heating element is reduced but, also, the thickness of the partition wall 4 is considerably decreased, and thus, output from the heating element is increased. Furthermore, the burning of the electrodes due to sparks between the electrodes and PTC thermister body can be prevented by the two or three layer structure of the electrodes. When the layers 3, 11, 13 and 14 become thin, the PTC thermister body 1 also becomes thin, and has a thickness value of from 3.5 to 6 mm, preferably approximately 3.5 mm, while heat generation from the PTC thermister body is maintained at a high level.

The nickel, zinc or chromium, which constitutes the outer layer of the heating element with two and three electrode layers, improves the resistance to weather of the known silver electrode of the honeycomb heating element. The outer layer made of nickel, zinc or chromium, prevents the electromigration of silver of the inner layer.

In the production of the PTC thermister with a honeycomb structure it is preferable to use the process disclosed in U.S. Pat. Ser. No. 882,922, mentioned above. In this disclosed, process for producing the PTC semiconductor ceramic material, the powdered ingredients of the semiconductor ceramic material are compressed under a pressure of 0.2 to 1.0 ton/cm$^2$, so as to produce a green compact. This green compact is then presintered at a temperature of from 1050° to 1200° C. The presintered body is then pulverized to grain size of from 1.5 to 2.5 microns and, then, well mixed with an organic binder, such as polyvinyl alcohol, thereby making the mixture easily shapable. The weight ratio of ceramic material powder relative to the organic binder should be from 8 to 12. The dispersed ceramic material is then extruded through a mesh or die, to provide the material with the required shape of the honeycomb PTC thermister body, and subsequently, dried at a temperature of approximately 200° C. The shaped body of the ceramic material is then sintered at a temperature of from 1250° to 1330° C., for 0.5 to 2 hours.

The PTC thermister body 1 having a honeycomb structure is then subjected to the formation of the two electrode layers or the three electrode layers.

According to the process for the formation of the two electrode layers, the inner layer 3 (FIG. 6) comprising silver and an adhesive oxide or oxides is formed by a printing method on both ends of the honeycomb PTC thermister body 1. Namely, an electrode paste comprising mainly silver powder and additionally an adhesive oxide(s), such as a lead borosilicate glass (frit), is applied on both ends mentioned above and is baked at a temperature of from 500° to 700° C. As to the electrode paste, various silver pastes are available on the market. Such paste comprise, for example, silver, a metal for providing the ohmic contact between the electrode and PTC thermister, such as In, Ga, Zn, Cd, Bi and Sn, an adhesive glass oxide having a low softening temperature, an organic binder and solvent. The adhesive glass oxide is melted or softened during the baking and provides the bonding between the paste and the PTC thermister body.

After the formation of the inner layer, the outer layer 11 is plated or deposited by a plating method, i.e. an electrolytic plating or chromating method, on the inner layer 3. A preferable condition for deposition is as follows.

Nickel: a plating solution containing from 250 to 350 g/l of nickel sulfate ($NiSO_4$), and having a current density of from 1 to 5 ampere per dm$^2$ of the inner layer.

Zinc: a plating solution containing from 30 to 100 g/l of zinc sulfate ($ZnSO_4$), and having a current density of from 1 to 5 ampere per dm$^2$ of the first layer.

Chromium: a chromating solution containing from 3 to 10 g/l of potassium chromate ($K_2CrO_4$).

It is preferable to plate or deposit only one of the nickel, chromium and zinc, and thus to carry out the plating process simply, although it is possible to deposit a combination of two or all these metals. The anode used in the plating process is a plate of nickel or zinc. A direct current is conducted between the anode and the PTC thermister, which is dipped in the electrolytic, nickel or zinc plating solution, and a coating layer of nickel or zinc is uniformly electrolytically deposited on the inner layer 3.

According to the process for the formation of the three electrode layers, the process for the formation of the inner layer 3 (FIG. 7) is the same as that of the inner layer 3 (FIG. 6). The intermediate layer 13 (FIG. 7) is electrolytically deposited or screen printed on the inner layer 3. A preferable condition for this electrolytic deposition is as follows.

Gold: a plating solution containing from 5 to 10 g/l of gold citrate, and having a current density of from 0.5 to 1.0 ampere per dm$^2$ of the inner layer.

Copper: a plating solution containing from 70 to 130 g/l of copper pyrophosphate, and having a current density of from 1 to 5 ampere per dm$^2$ of the inner layer. The anode used in the plating process is made of copper or gold plate. A direct current is passed between the anode and the PTC thermister, which is dipped in the electrolytic solution. It is preferable to deposit only one of the copper and gold, although it is possible to deposit a copper silver alloy.

The intermediate metallic layer, particularly a silver layer, 13 may be formed on the inner metallic layer 3 by a printing method. In the printing method, a paste consisting of a metal, e.g. silver, in powdered form and an organic binder is applied and, then, baked at a temperature from 500° to 700° C. It is not necessary for an adhesive glass oxide to be a component of the paste. The glass is, therefore, not contained in the intermediate layer 13, with the result that the disadvantages resulting from the glass, such as a lead borosilicate glass, can advantageously eliminated in the three electrode layers proposed by the present invention.

The process for producing the outer layer 14 (FIG. 7) may be the same as the process for producing the outer layer 11 (FIG. 6).

CONTROL EXAMPLE 1

Figure 1:
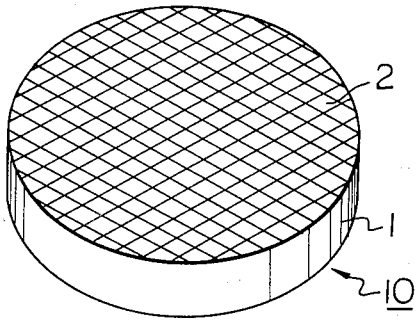
FIG. 1 is an illustration of a honeycomb body of the heating elements.
Figure 2:
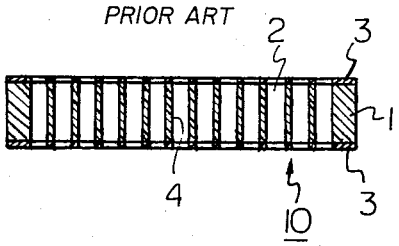
Fig. 2 PRIOR ART
FIG. 2 is a cross sectional view of the honeycomb body according to a known heating element.
Figure 3:
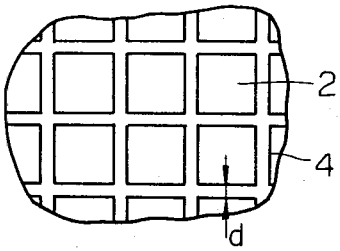
FIG. 3 is an enlarged partial plan view of the honeycomb body according to FIG. 1.
Figure 4:
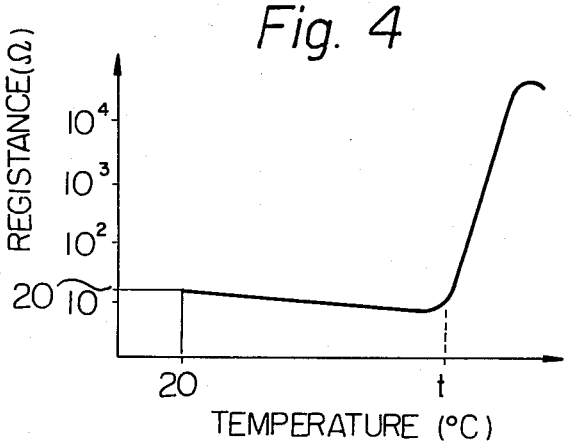
FIG. 4 is a graph representing a relationship between resistance and temperature of a PTC thermister.
Figure 5:
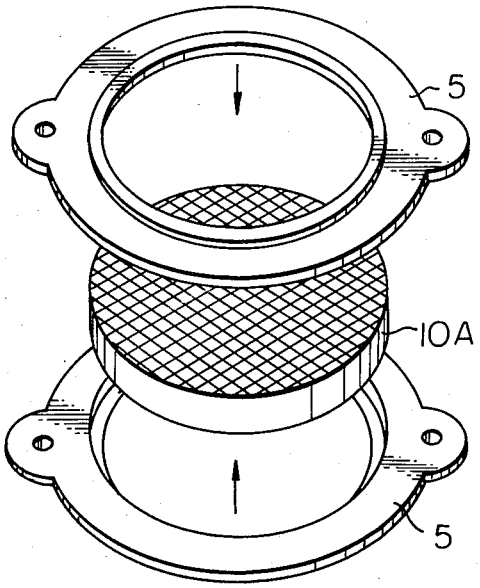
FIG. 5 is a view of the honeycomb body illustrated in FIG. 1 and a conductor for supplying a power to the honeycomb body.

The main composition of a PTC thermister was prepared in a powdered form so that the composition contained 52 weight % of BaO, 13 weight % of PbO, and 35 weight % of $TiO_2$. A semiconductor forming element, i.e. $Y_2O_3$, in an amount of 0.15 weight % and manganese in an amount of 0.001 weight %, was added to the main composition and the powder was shaped by a sintering method into honeycomb structure as illustrated in FIGS. 1 and 3. In the sintering process, the ingredients were mixed by a ball mill, compressed, presintered at a temperature of 1130° C., pulverized to grain sizes of from 1.5 to 2.0 microns and mixed with an organic binder of polyvinyl alcohol in an amount of 10% by weight. The mixture of the presintered ceramic material and the organic binder was then extruded through the dies so as to shape the mixture into a honeycomb structure, and then, sintered at a temperature of from 1250° C. to 1300° C. The resistance of the PTC thermister at 20° C. was 20 ohm. The diameter and thickness of the honeycomb body 1 were 40 mm and 10 mm, respectively. A number of through holes 2 having a 1 mm width were defined by the partition wall 4 having a 0.2 mm thickness. The resistance of the honeycomb PTC thermister was changed depending upon temperature as shown in FIG. 4, in which the Curie point (t) was 185° C. A paste consisting mainly of approximately 90% of silver particles, approximately 4% of lead borosilicate glass and the balance of indium and gallium was applied on both ends surfaces of the partition wall 4 of the PTC thermister, by means of a screen printing method, and then, baked at a temperature of 600° C., thereby providing the ohmic electrodes 3, 20 microns thick. The honeycomb heating body 10A produced as explained above was coupled with a pair of the conductors or terminals 5 illustrated in FIG. 5.

Power from a commercial alternating current source of 100 volt was applied to the honeycomb heating body 10A through the conductors 5 in such a manner that one operation cycle consisting of one minute conduction and one minute interruption was repeated for twenty cycles. After the power application, it was observed that several portions of the electrode 3 were burned.

CONTROL EXAMPLE 2

The same honeycomb heating body as in Control Example 1, except for an electrode thickness of 30 microns, was subjected to the same power application test as in Control Example 1. No burning phenomena were observed after the test.

EXAMPLE 1

The honeycomb heating body 10A provided with silver ohmic electrodes having a 10 micron thickness was produced by the same procedure as in Control Example 1.

An electrolytic plating solution containing 250 g/l of $NiSO_4$, 50 g/l of $NiCl_2$, 40 g/l of boric acid, and having a pH of 5 and temperature of 40° C., was used to electrolytically deposit nickel on the silver ohmic electrodes (the inner layer 3 (FIG. 6)) to a thickness of 5 microns. Current at a density of 5 ampere/$dm^2$ was conducted through the solution over a period of 20 minutes.

The honeycomb heating element so produced was subjected to the same power application test as in Control Example 1. No burning phenomena were observed after the test.

EXAMPLE 2

The honeycomb heating body 10A provided with the silver ohmic electrodes having a 10 micron thickness was produced by the same procedure as in Control Example 1.

An electrolytic plating solution containing 70 g/l of $ZnSO_4$ and having a pH of 1 and temperature of 25° C., was used to electrolytically deposit zinc on the silver ohmic electrodes (the inner layer 3 (FIG. 6)) to a thickness of 5 microns. Current at a density of 5 ampere/$dm^2$ was conducted through the solution over a period of 20 minutes.

The honeycomb heating element so produced was subjected to the same power application test as in Control Example 1. No burning phenomena were observed after the test.

EXAMPLE 3

The honeycomb heating body 10A provided with the silver ohmic electrodes having a 10 micron thickness was produced by the same procedure as in Control Example 1.

An electrolytic plating solution containing 70 g/l of $ZnSO_4$, and having a pH of 1 and temperature of 25° C., was used to electrolytically deposit zinc on the silver ohmic electrodes (the first layer 3 (FIG. 6)) to a thickness of 5 microns.

The honeycomb heating element so produced was subjected to the same power application test as in Control Example 1. No burning phenomena were observed after the test.

The chromate conversion process was carried out under the 5 g/l of potasium chromate solution, thereby depositing a chromium layer of 100 angstroms in thickness on the zinc layer.

EXAMPLE 4

The honeycomb heating body 10A provided with the silver electrode 3 (FIG. 7) having a 10 micron thickness was produced by the same procedure as in Control Example 1. The ohmic contact was thus provided between each of the silver electrodes 3 (FIG. 7) and the honeycomb heating body 10A consisting of the PTC thermister.

A silver layer 13 of 5 micron thickness was formed on each of the ohmic, silver electrodes 3 by screen printing a silver paste consisting of mainly silver powder and, additionally, organic binder, and then, baking the powder composition at 600° C.

An electrolytic plating solution containing 300 g/l of $NiSO_4$, 50 g/l of $NiCl_2$ and 40 g/l of boric acid, and having a pH of 5 and temperature of 40° C., was used to electrolytically deposit nickel on the each of the silver intermediate layers 13 to a thickness of 5 microns. Current at a density of 5 ampere/$dm^2$ was conducted through the solution over a period of 20 minutes.

The honeycomb heating element so produced was subjected to the same power application test as in Control Example 1. No burning phenomena were observed after the test.

The honeycomb heating element was subjected to a weathering test stipulated under the ASTM Standard D 2247 and a resistant test against saliferous water stipulated under the ASTM Standard B 287. No abnormalities were observed during the tests.

EXAMPLE 5

The process of Example 4 was repeated. However, instead of the screen printing of the intermediate silver layer 13 used in Example 4, the electrolytic deposition as explained below was employed for forming the intermediate gold layers 13. The honeycomb heating element 10A provided with the intermediate layers was dipped into an electrolytic plating solution containing 10 g/l of gold citrate, and having a pH of 4.0 and temperature of 25° C. Current at a density of 0.7 ampere/dm2 was conducted through the solution over a period of 20 minutes. The testing results were the same as in Example 4.

EXAMPLE 6

The process of Example 4 was repeated. However, instead of the nickel outer layers 14 in Example 4, zinc layers were deposited by the electrolytic process as explained in Example 2. The testing results were the same as in Example 4.

EXAMPLE 7

The process of Example 4 was repeated. However, instead of the nickel outer layers 14 in Example 4, the zinc and chromium layers were deposited as explained in Example 3. The testing results were the same as in Example 4.

EXAMPLE 8

The procedures of the foregoing Examples were repeated, except that the thickness of the PTC thermister body 1 was changed to 3.5 mm. The testing results were the same as in the foregoing Examples.

What we claim is:

1. A heating element comprising a semiconductor ceramic body of a honeycomb structure, the material of said semiconductor ceramic body having a positive temperature coefficient of resistance over a Curie point and composed of barium titanate, wherein a pair of inner electric conductive layers comprising mainly silver are provided on both end surfaces of said semiconductor ceramic body, electrically connected to a source for supplying power to said semiconductor ceramic body, and wherein an outer electric conductive layer consisting of at least one metal selected from the group, which consists of nickel, zinc and chromium is provided on each of the inner layers.

2. A heating element comprising a semiconductor ceramic body of a honeycomb structure, the material of said semiconductor ceramic body having a positive temperature coefficient of resistance over a Curie point and composed of barium titanate, wherein a pair of inner electric conductive layers are provided on both end surfaces of said semiconductor ceramic body, electrically connected to a source for supplying power to said semiconductor ceramic body, and wherein an intermediate layer consisting of at least one metal selected from the group, which consists of silver, gold and copper is provided on each of said inner layers, and an outer layer consisting of at least one metal selected from the group consisting of nickel, zinc and chromium is provided on each intermediate layer.

3. A heating element according to claim 1, wherein the total thickness of said inner and outer, layers is in the range of from 10 to 35 microns.

4. A heating element according to claim 2, wherein the total thickness of said inner, intermediate and outer, layers is in the range of from 15 to 40 microns.

5. A heating element according to claim 3 or 4, wherein the thickness of each of the inner layers is in the range of from 5 to 10 microns.

6. A heating element according to claim 4, wherein the thickness of the intermediate layer is in the range of from 5 to 20 microns, and the thickness of outer layer is in the range of from 3 to 7 microns.

7. A heating element according to claim 5 or 6, wherein the thickness of the partition wall of said honeycomb structure is in the range of from 0.15 to 3 mm.

8. A heating element according to claim 7, wherein the thickness of said semiconductor ceramic body of a honeycomb structure is from 3.5 to 6 mm.

9. A heating element comprising a semiconductor ceramic body of a honeycomb structure, the material of said semiconductor ceramic body having a positive temperature coefficient of resistance over a Curie point and composed of barium titanate having electrical conductive terminal layers attached by a process comprising a step of screen printing a pair of inner electric conductive layers comprising mainly silver on both end surfaces of said semiconductor ceramic body, wherein said process further comprises the steps of:

electrolytically depositing an intermediate electric conductive layer, consisting of at least one metal selected from the group which consists of silver, gold and copper, on each of said inner layers, and plating on each intermediate layer an outer electric layer consisting of at least one metal selected from the group which consists of nickel, zinc and chromium.

10. A heating element comprising a semiconductor ceramic body of a honeycomb structure, the material of said semiconductor ceramic body having a positive temperature coefficient of resistance over a Curie point and composed of barium titanate having electrically conductive terminal layers attached by a process comprising a step of screen printing a pair of inner electric conductive layers comprising mainly silver on both end surfaces of said semiconductor ceramic body, wherein said process further comprises the steps of:

screen printing an intermediate electric conductive layer, consisting of at least one metal selected from the group which consists of silver, gold and copper, on each of said inner layers, and plating on each intermediate layer an outer electric conductive layer consisting of at least one metal selected from the group which consists of nickel, zinc and chromium.

11. A heating element according to claim 9 or 10 wherein the total thickness of said inner, intermediate and outer layers is in the range of from 15 to 40 microns.

12. A heating element according to claim 11, wherein the thickness of the intermediate layer is in the range of from 5 to 20 microns, and the thickness of the outer layer is in the range of from 3 to 7 microns.

13. A heating element comprising a semiconductor ceramic body of a honeycomb structure, the material of said semiconductor ceramic body having a positive temperature coefficient of resistance over a Curie point and composed of barium titanate having electrically conductive terminal layers attached by a process comprising a step of screen printing a pair of inner electric conductive layers on both end surfaces of said semiconductor ceramic body, wherein said process further comprises a step of:

plating an outer electrically conductive layer consisting of at least one metal selected from the group which consists of nickel, zinc and chromium, on each of said inner layers.

14. A heating element according to claim 13, wherein the thickness of the inner layers is in the range of from 5 to 10 microns.

* * * * *